US008801051B2

(12) United States Patent
Hobbs et al.

(10) Patent No.: US 8,801,051 B2
(45) Date of Patent: Aug. 12, 2014

(54) DOUBLE SWING LATCH ASSEMBLY

(76) Inventors: Kenneth Hobbs, Yukon, OK (US); Travis Gorbet, El Reno, OK (US); Bobby Key, Tuttle, OK (US); Tim Adams, Yukon, OK (US); Craig Starnes, Piedmont, OK (US); William Patchell, Yukon, OK (US); Lowell Miller, Newcastle, OK (US)

( * ) Notice: Subject to any disclaimer, the term of this patent is extended or adjusted under 35 U.S.C. 154(b) by 204 days.

(21) Appl. No.: 13/417,956

(22) Filed: Mar. 12, 2012

(65) Prior Publication Data

US 2013/0234450 A1 Sep. 12, 2013

(51) Int. Cl.
*E05C 1/08* (2006.01)

(52) U.S. Cl.
USPC ..... 292/163

(58) Field of Classification Search
USPC ..... 292/32, 137, 163, 164, 341.15, 341.18, 292/DIG. 29, DIG. 61
See application file for complete search history.

(56) References Cited

U.S. PATENT DOCUMENTS

| | | | | |
|---|---|---|---|---|
| 707,910 | A | 8/1902 | Fischer | |
| 2,822,630 | A | 2/1958 | Guyer | |
| 2,869,952 | A * | 1/1959 | Saunders | 312/405 |
| 3,208,791 | A | 9/1965 | Coscione | |
| 4,198,085 | A | 4/1980 | Schacter | |
| 4,222,149 | A | 9/1980 | Holbek | |
| 4,241,888 | A | 12/1980 | Bredemus | |
| 5,148,629 | A | 9/1992 | Minami | |
| 5,829,197 | A | 11/1998 | Oh | |
| 6,805,393 | B1 | 10/2004 | Stevenson | |
| 7,393,026 | B2 * | 7/2008 | Ikeda et al. | 292/341.15 |
| 2008/0111382 | A1 * | 5/2008 | Duan et al. | 292/164 |
| 2010/0237636 | A1 * | 9/2010 | Juga et al. | 292/341 |

FOREIGN PATENT DOCUMENTS

| | | |
|---|---|---|
| JP | 2002-317581 | 10/2002 |

* cited by examiner

*Primary Examiner* — Kristina Fulton
*Assistant Examiner* — Christine M Mills
(74) *Attorney, Agent, or Firm* — McAfee & Taft

(57) ABSTRACT

A latch assembly for securing a gate or other pivotal structure that includes a pair of independently retractable outwardly biased latch members carried by a latch carriage. When in an extended position, the latch members define a striker retention slot. Cooperation of the latch members in the extended position provides for retention of a striker member in the striker retention slot. The latch members are supported by rods that pass through the latch carriage.

12 Claims, 11 Drawing Sheets

DOUBLE SWING LATCH ASSEMBLY

BACKGROUND

Latch assemblies are typically used to secure a gate or other moveable structure in a particular position or configuration. Common latch assemblies typically include a latch that retains a striker in a space defined between the latch and a frame carrying the latch. This latch assembly configuration only permits retention and release of the striker from one edge of the assembly, thereby limiting the travel and configurability of a gate or other moveable structure carrying the striker. Thus, a latch assembly providing improved configurability is desirable.

SUMMARY

The present disclosure provides a latch assembly for securing and releasing a gate or other moveable structure from either side of the latch assembly.

In one embodiment, the latch assembly includes a latch carriage, a pair of independently retractable, outwardly biased latch members, and a striker retention slot. The latch carriage carries the latch members. When in an extended position, the latch members define the striker retention slot. The cooperation of the latch members in the extended position provides for retention of a striker member in the striker retention slot.

In another embodiment, the latch assembly includes a housing supporting the latch assembly, a latch carriage, a pair of outwardly biased latch members, and a striker retention slot. The latch carriage carries the latch members. The latch carriage is axially moveable from a first position to a second position relative to the housing. The latch members are independently and axially retractable. The latch members define the striker retention slot. When the latch carriage is in the first position, the latch members cooperate to provide for lateral retention of a striker member in the striker retention slot. Conversely, locating the latch carriage in the second position separates the striker retention slot from the striker member by a sufficient distance to preclude retention of the striker member therein.

In yet another embodiment, the latch assembly includes a housing supporting the latch assembly, a latch carriage, a pair of independently retractable, outwardly biased latch members, and a striker retention slot. The latch carriage carries the latch members. The latch carriage is axially moveable from a first position to a second position relative to the housing. The configuration of the outwardly biased latch members permits retraction of the latch members upon lateral impact by a striker member. When in an extended position, the latch members define the striker retention slot. When the latch carriage in the first position, the latch members cooperate to provide for lateral retention of a striker member in the striker retention slot. Conversely, locating the latch carriage in the second position separates the striker retention slot from the striker member by a distance sufficient to permit release of the striker member from the striker retention slot.

BRIEF DESCRIPTION OF THE DRAWINGS

FIG. 6 is a cross-sectional view of FIG. 5 taken at line 6-6.

FIG. 9A is a front view of an embodiment of a housing with a latch carriage in a first position, one latch member in an extended position, and one latch member in a retracted position upon receiving an impact from a striker member.

FIG. 9B is a front view of the embodiment of FIG. 9A with the retracted latch member returned to the extended position after receiving the impact from the striker member, and the striker member retained in a striker retention slot.

DETAILED DESCRIPTION

The present disclosure provides a double swing latch assembly. The configuration of the latch assembly provides for securing and releasing a gate or other moveable structure from either side of the latch assembly. The latch assembly is particularly suitable for use in connection with a housing. The latch assembly may be supported on the exterior of the housing or, as depicted in FIGS. 4-9B, supported within the interior of the housing. As used herein, the term housing includes without limitation, gate posts, gate frames, fence posts, pipes, channels, and tracks.

Referring generally to the drawings, latch assembly 10 includes a latch carriage 12, a pair of independently retractable latch members 14, and a striker retention slot 16.

As used herein, the phrase "axially movable" refers to movement on a longitudinal axis.

Figure 1A:
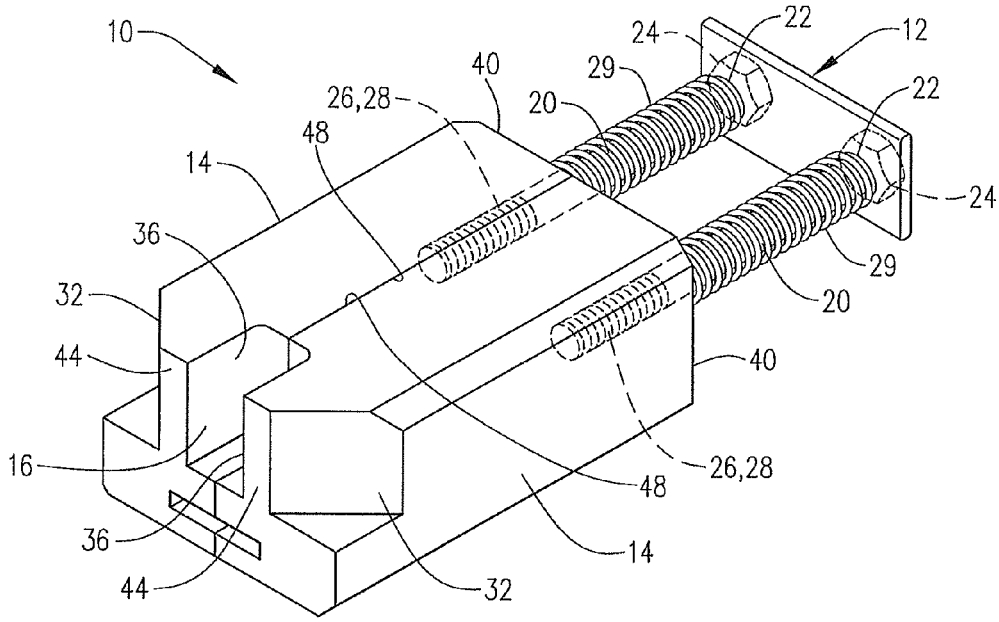
FIG. 1A is a front perspective view of an embodiment of the latch assembly.
Figure 1B:
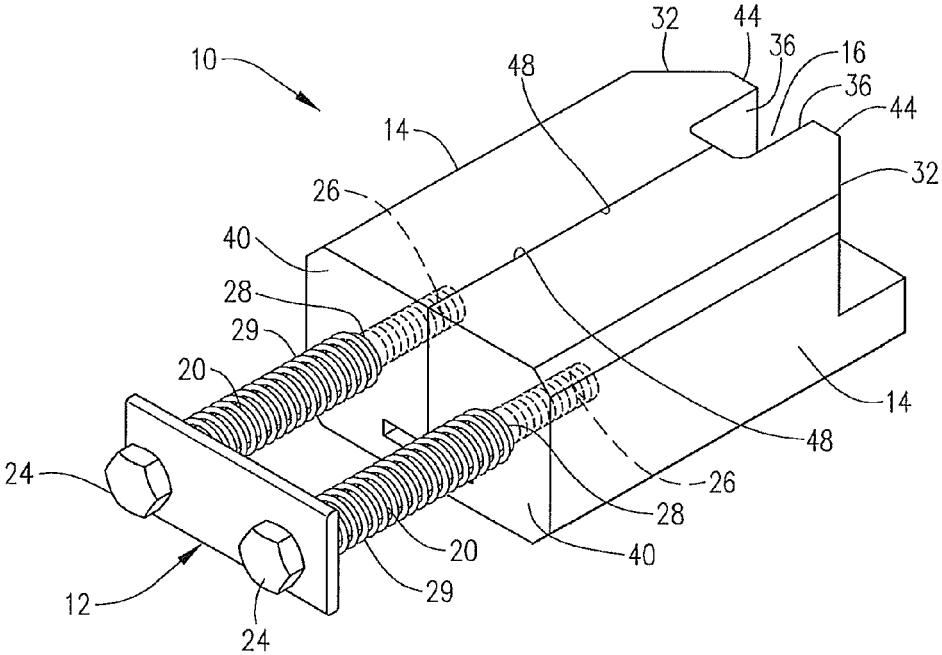
FIG. 1B is a reverse perspective of the embodiment of the latch assembly of FIG. 1A.
Figure 2:
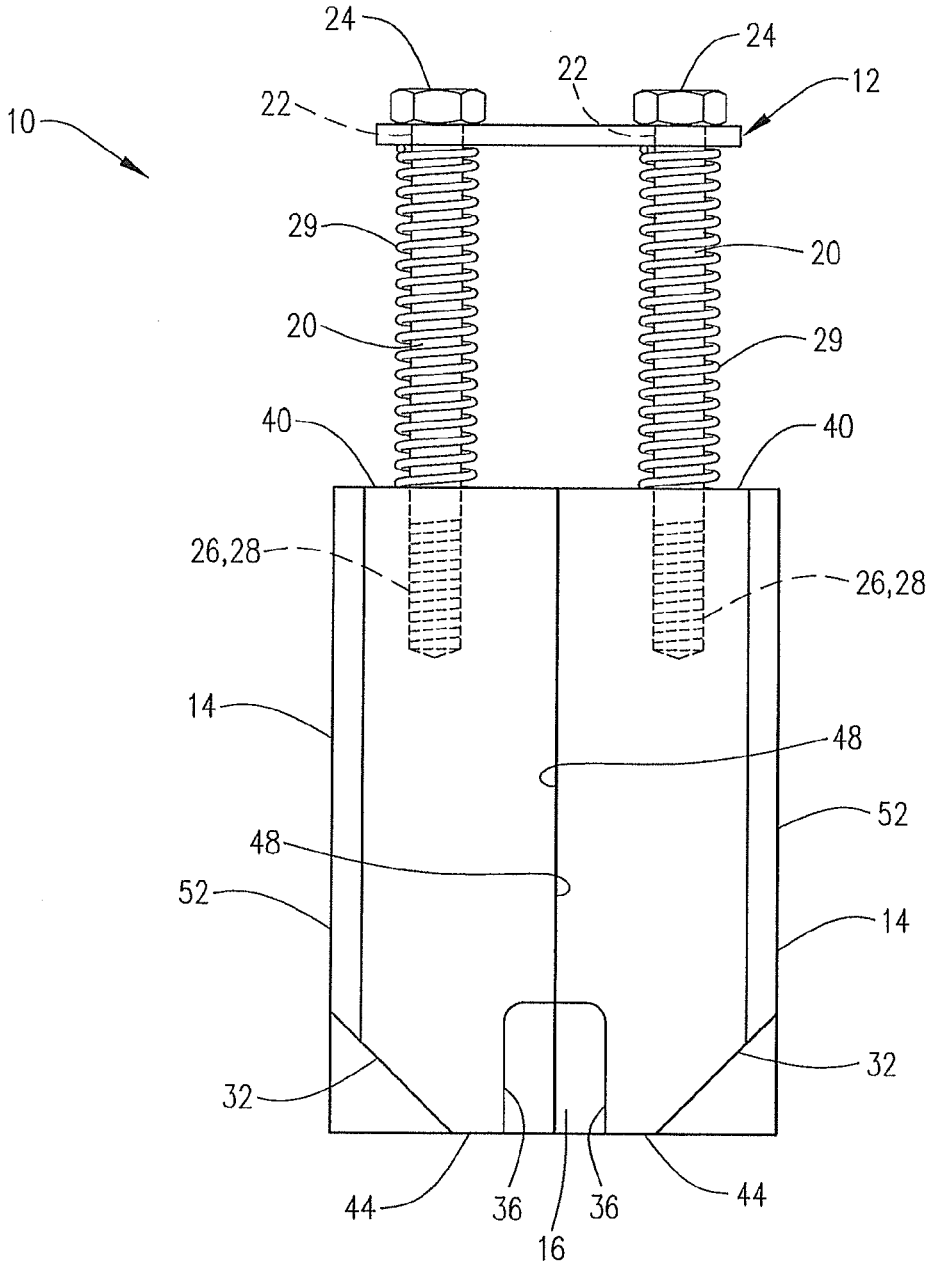
FIG. 2 is a front plan view of an embodiment of the latch assembly.
Figure 3A:
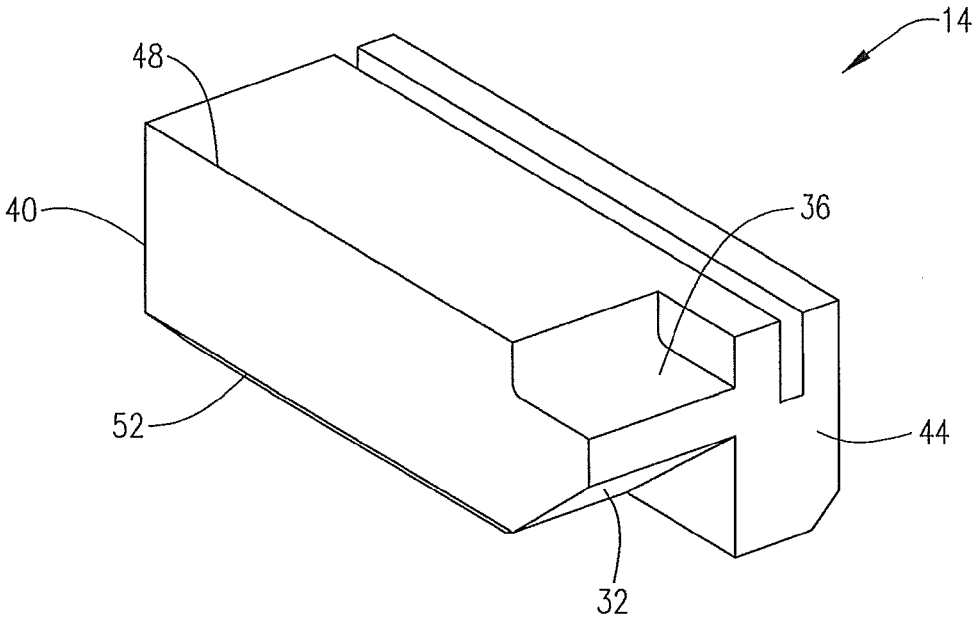
FIG. 3A is a perspective view of an embodiment of a latch member illustrating a second end of the latch member.
Figure 3B:
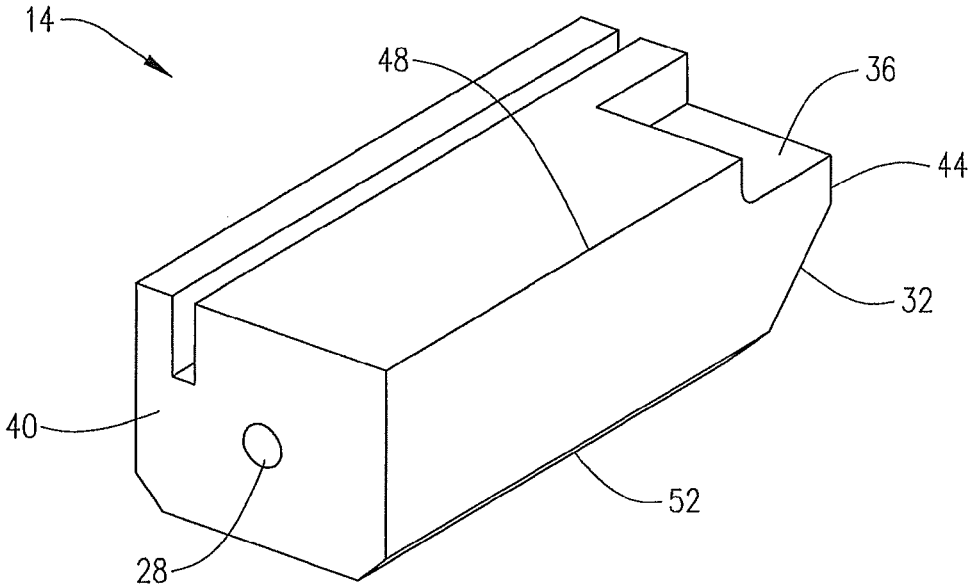
FIG. 3B is a perspective view illustrating a first end of the latch member of FIG. 3A.
Figure 4:
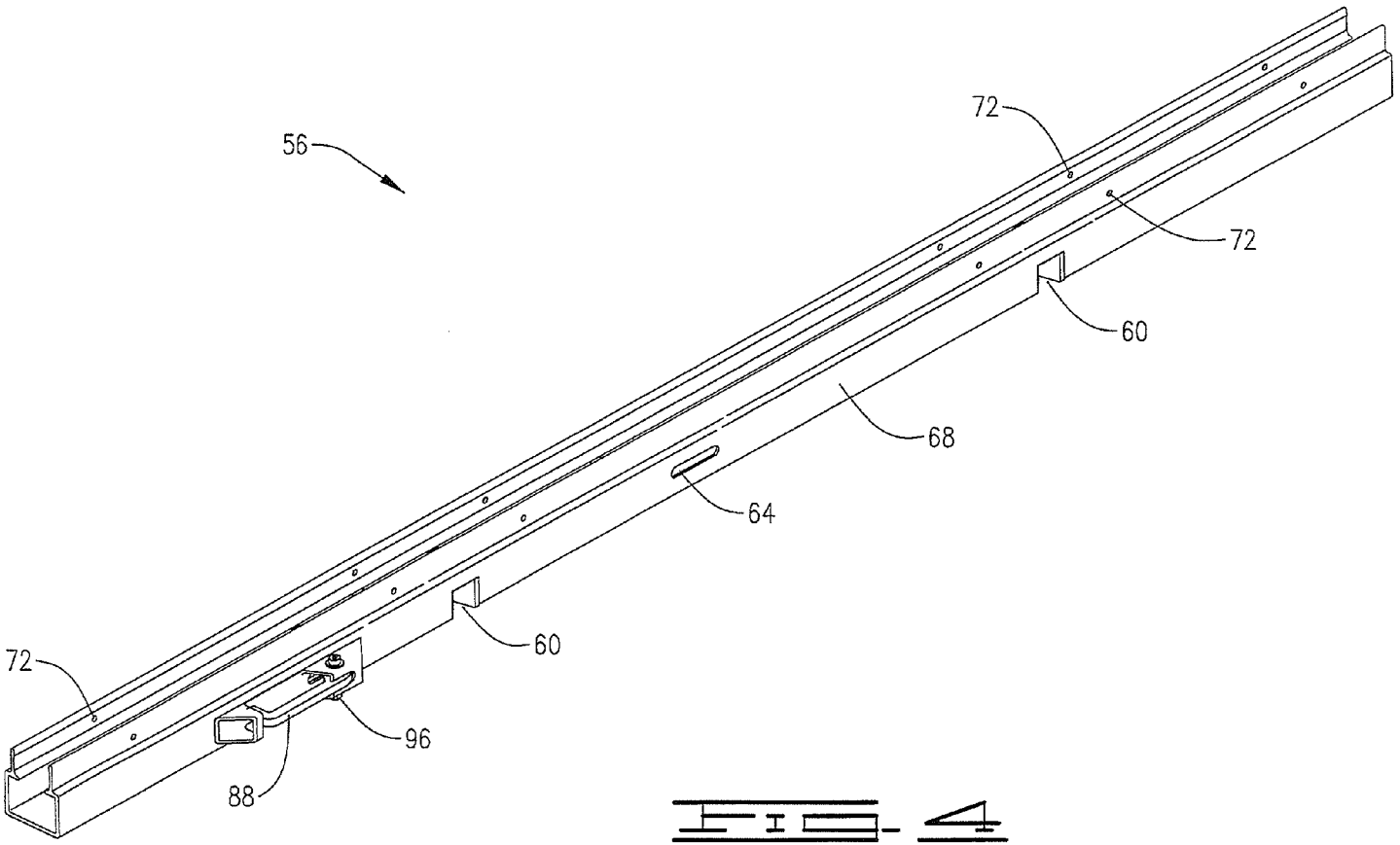
FIG. 4 is a perspective view of an embodiment of a housing.
Figure 5:
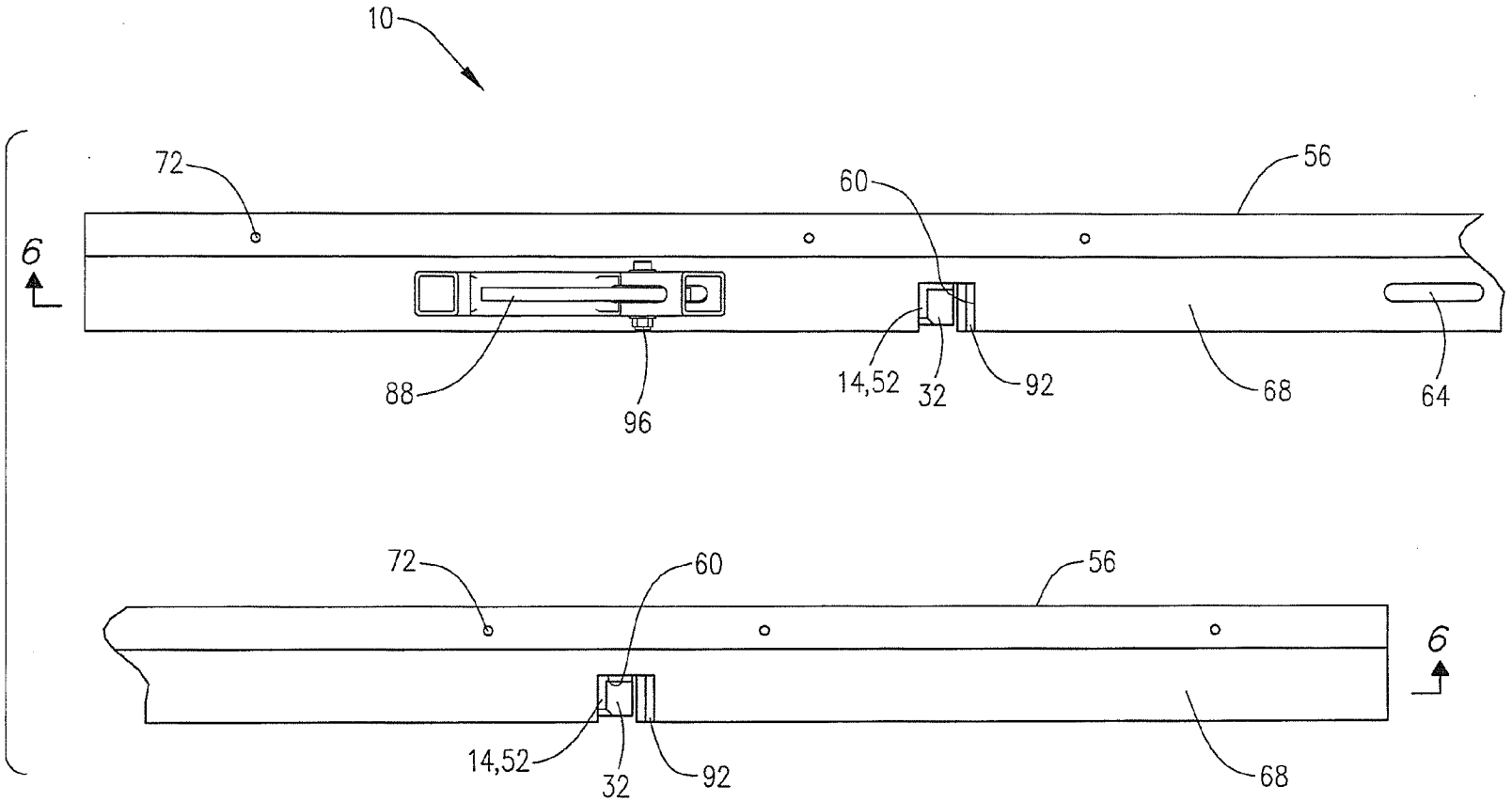
FIG. 5 is a side view of an embodiment of the latch assembly including a housing.
Figure 5:
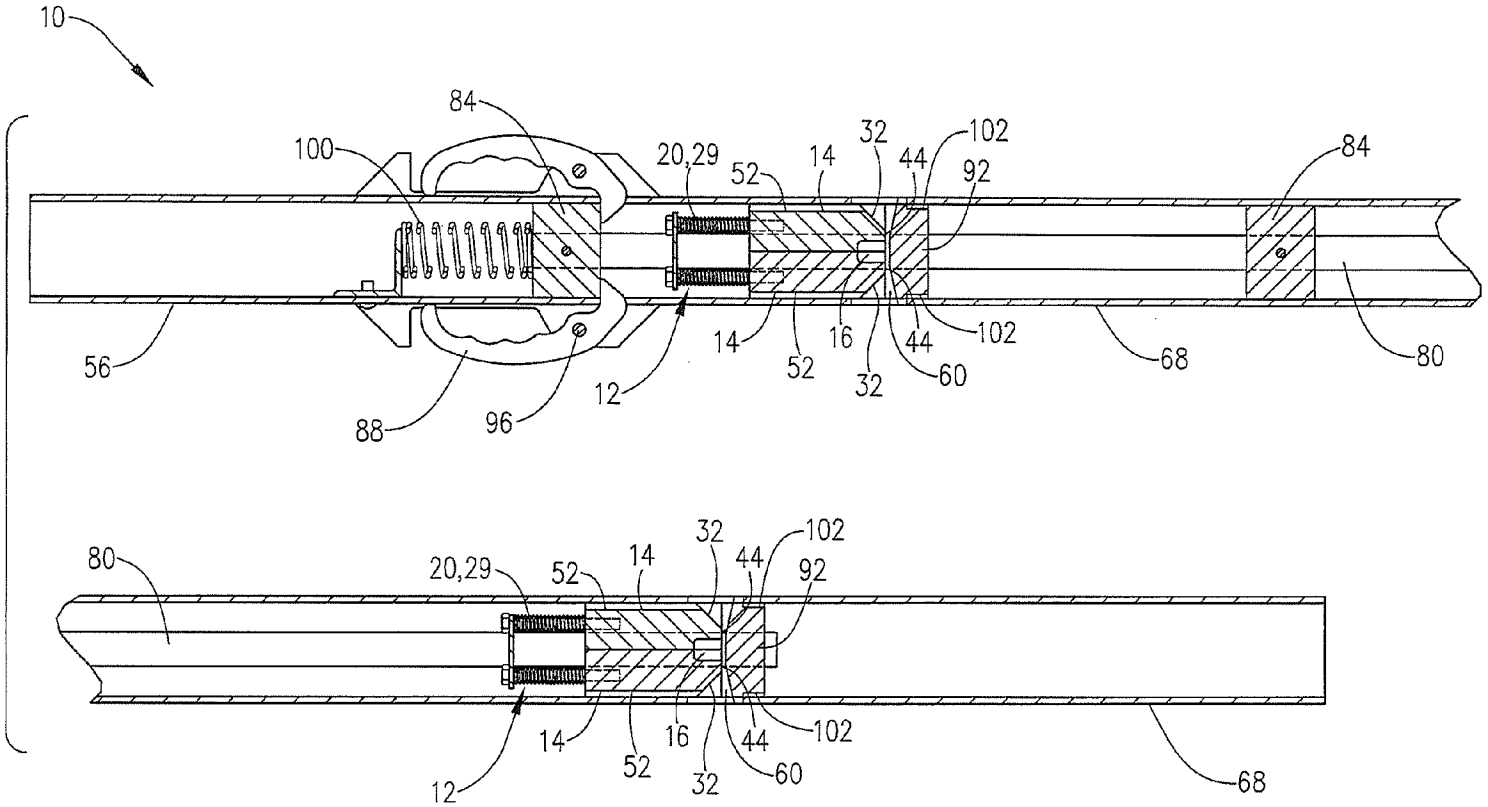
Figure 7:
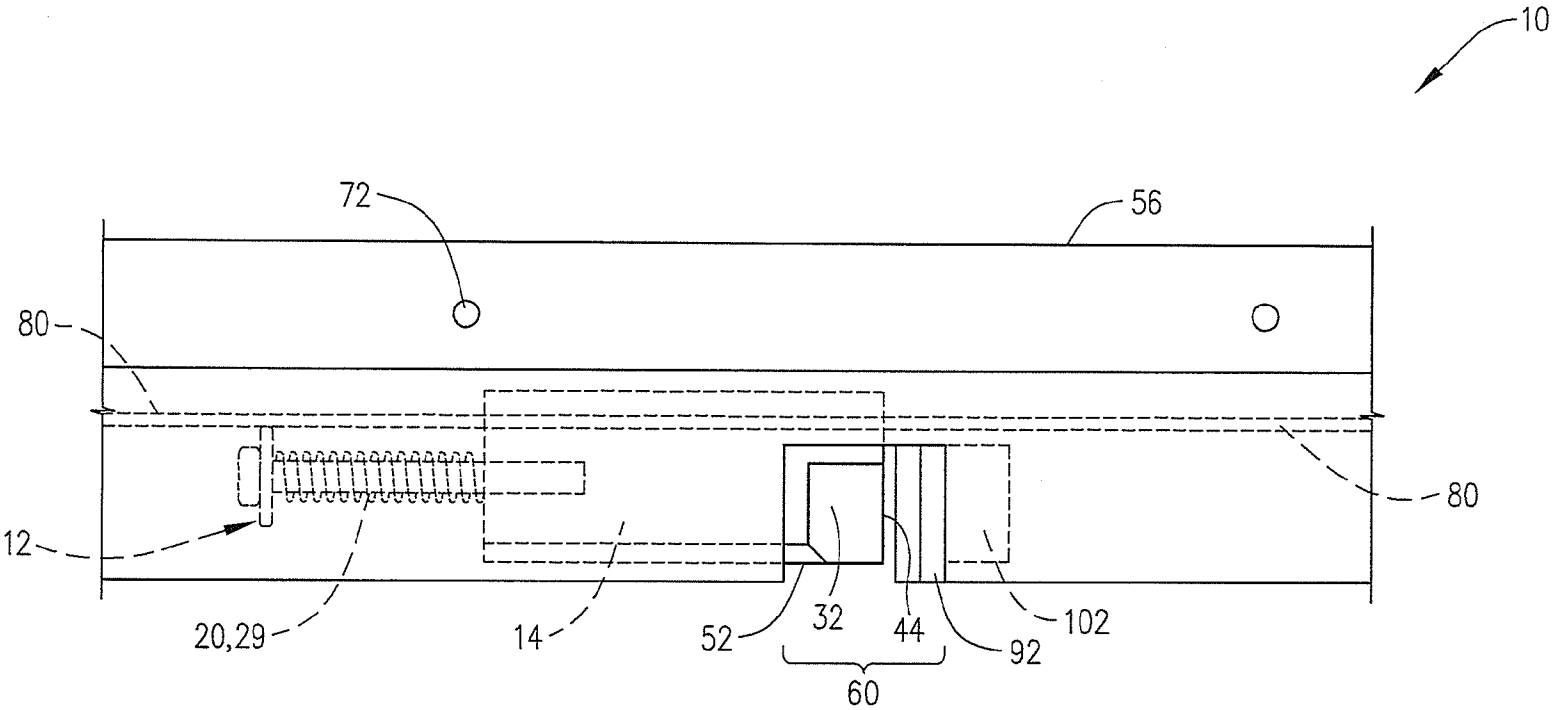
FIG. 7 is a detailed side view of the housing of FIG. 5 illustrating the latch assembly therein.

Referring to FIGS. 1-2, latch carriage 12 supports a pair of rods 20 with each rod 20 passing through a rod guide 22. One end of rod 20 carries a head 24 in the form of a bolt head, nut, or other suitable device for retaining rod 20 rod guide 22. The other end of rod 20 has a threaded portion 26. Secured to threaded portion 26 of each rod 20 is latch member 14. As depicted, latch member 14 has a rod mounting hole 28 to permit attachment to rod 20. Each rod 20 is movable within associated rod guide 22 along the length of each rod 20 between head 24 and latch member 14.

Alternative embodiments for securing latch member 14 to rod 20 may include any suitable mechanism. For example, adhesives and press fitting etc. will be appropriate for securing rod 20 within or to latch member 14. Further, the present disclosure contemplates alternative embodiments for rods 20.

For example, latch carriage 12 may alternately include a track or keyway for carrying latch members 14.

As depicted in FIGS. 1-2, each rod 20 carries a spring 29 positioned between rod guide 22 and latch member 14 to provide an outward bias of latch member 14. Alternative embodiments for providing the desired outward bias of latch member 14 may include a single coil spring or leaf spring positioned between latch carriage 12 or rod guide 22 and latch members 14, or a pair of hydraulic cylinders positioned between latch carriage 12 and each latch member 14.

Referring now to FIGS. 1-3B, each latch member 14 includes a beveled surface 32 and a recess 36. Further, each latch member 14 has a first end 40, a second end 44, an inner edge 48, and an outer edge 52. First end 40 of each latch member 14 carries the previously described rod mounting hole 28. Second end 44 and inner edge 48 of latch member 14 meet at recess 36. Outer edge 52 and second end 44 of latch member 14 meet at beveled surface 32. Recess 36 of one latch member 14 is complementary to recess 36 of the other latch member 14 when inner edges 48 of latch members 14 are facing one another. To reduce noise of operation, latch members 14 are generally manufactured from any suitable polymeric material; however, other materials including but not limited to steel are suitable for use as latch members 14.

Each latch member 14 is independently retractable and outwardly biased to an extended position relative to latch carriage 12. As discussed in further detail below, upon receiving a lateral impact, beveled surface 32 imparts axial force on latch member 14, thereby axially and individually retracting latch member 14. Each latch member 14 is axially moveable on the length between head 24 and first end 40 of latch member 14. When each latch member 14 is in the extended position, head 24 engages rod guides 22 as shown in FIGS. 1-2.

Continuing with FIGS. 1-3B, striker retention slot 16 is defined between latch members 14 by cooperation of each recess 36 when inner edges 48 of latch members 14 are facing one another and when each latch member 14 is in the extended position.

Referring to FIGS. 4-9B, latch assembly 10 may include a housing 56. Housing 56 provides lateral support for latch carriage 12 and latch members 14 of latch assembly 10 while permitting latch assembly 10 to axially move relative to housing 56. Housing 56 may be, for example, a gate post that when used in connection with the components of latch assembly 10 provides for securing a gate or other pivotal structure in a closed position. As shown, housing 56 is an elongate square tube having generally a rectangular cross-section. However, any configuration and material that will slidably accept the components of latch assembly 10 as described herein is acceptable.

In FIGS. 4-9B, housing 56 has a latch opening 60, an elongate opening 64, a wall 68, and a plurality of mounting points 72.

Latch opening 60 is a cut-out portion in wall 68 of housing 56 having a sufficient size to provide clearance for a striker member 76. FIGS. 9A-9B depict the passage of striker member 76 through latch opening 60 for retention within striker retention slot 16. Elongate opening 64 disposed through wall 68 of housing 56 provides external access to the interior of housing 56. Mounting points 72 permit securing of housing 56 to, for example, a gate post or other suitable support (not shown).

Figure 8A:
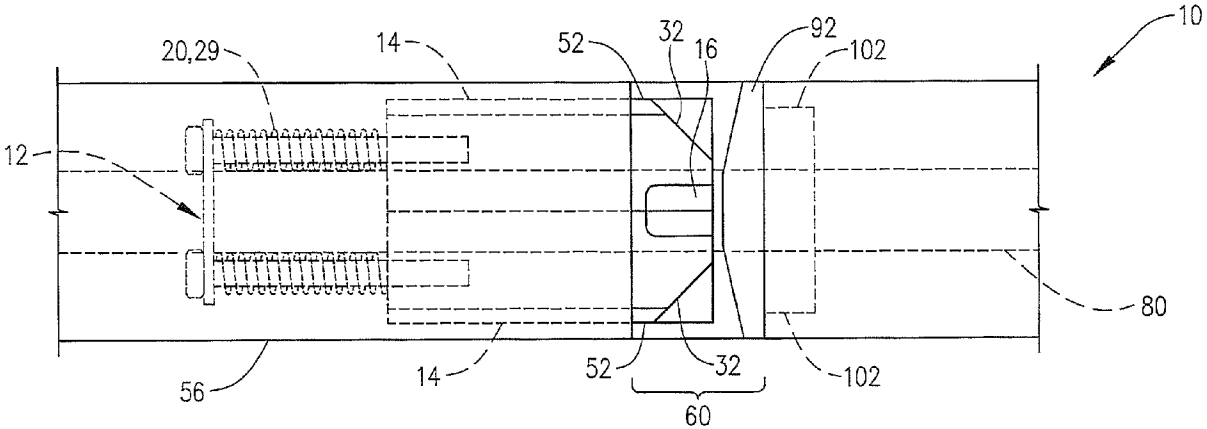
FIG. 8A is a detailed front view of the housing of FIG. 5 illustrating a latch carriage in a first position and a pair of latch members in an extended position.
Figure 8B:
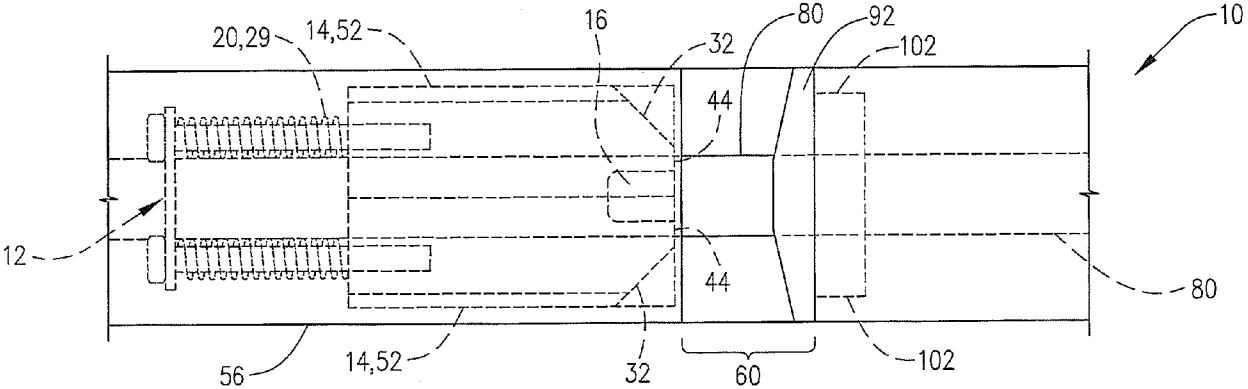
FIG. 8B is a detailed front view of the housing of FIG. 5 illustrating a latch carriage in a second position and a pair of latch members in an extended position.
Figure 4:
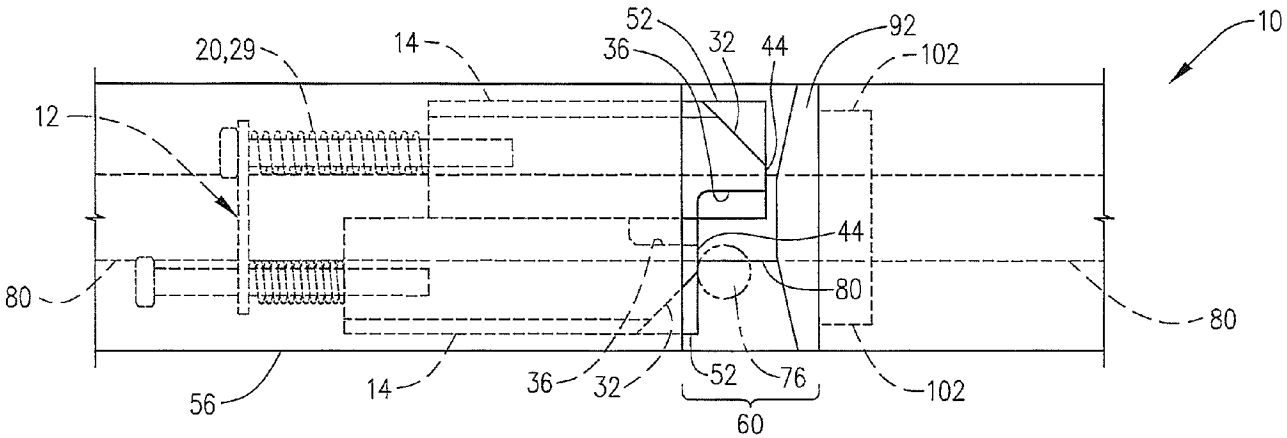
Figure 5:
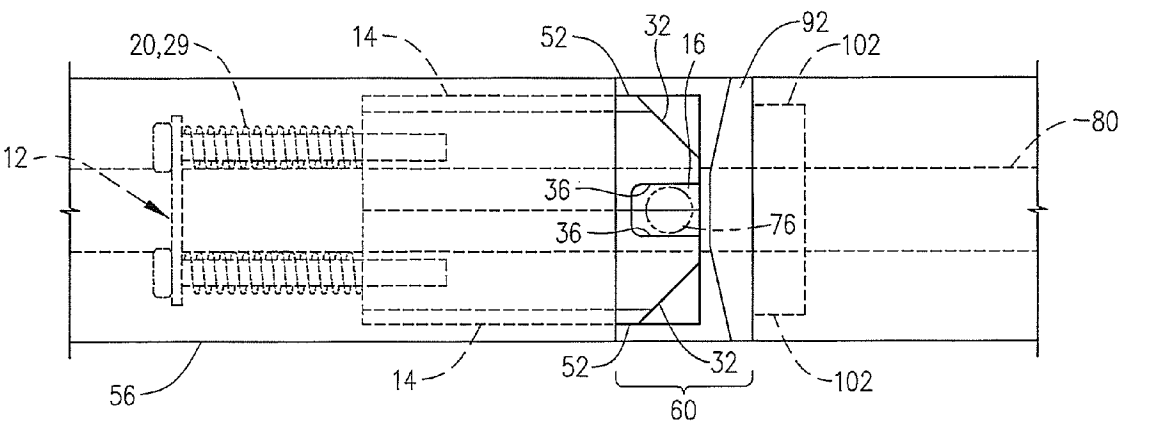
Figure 10:
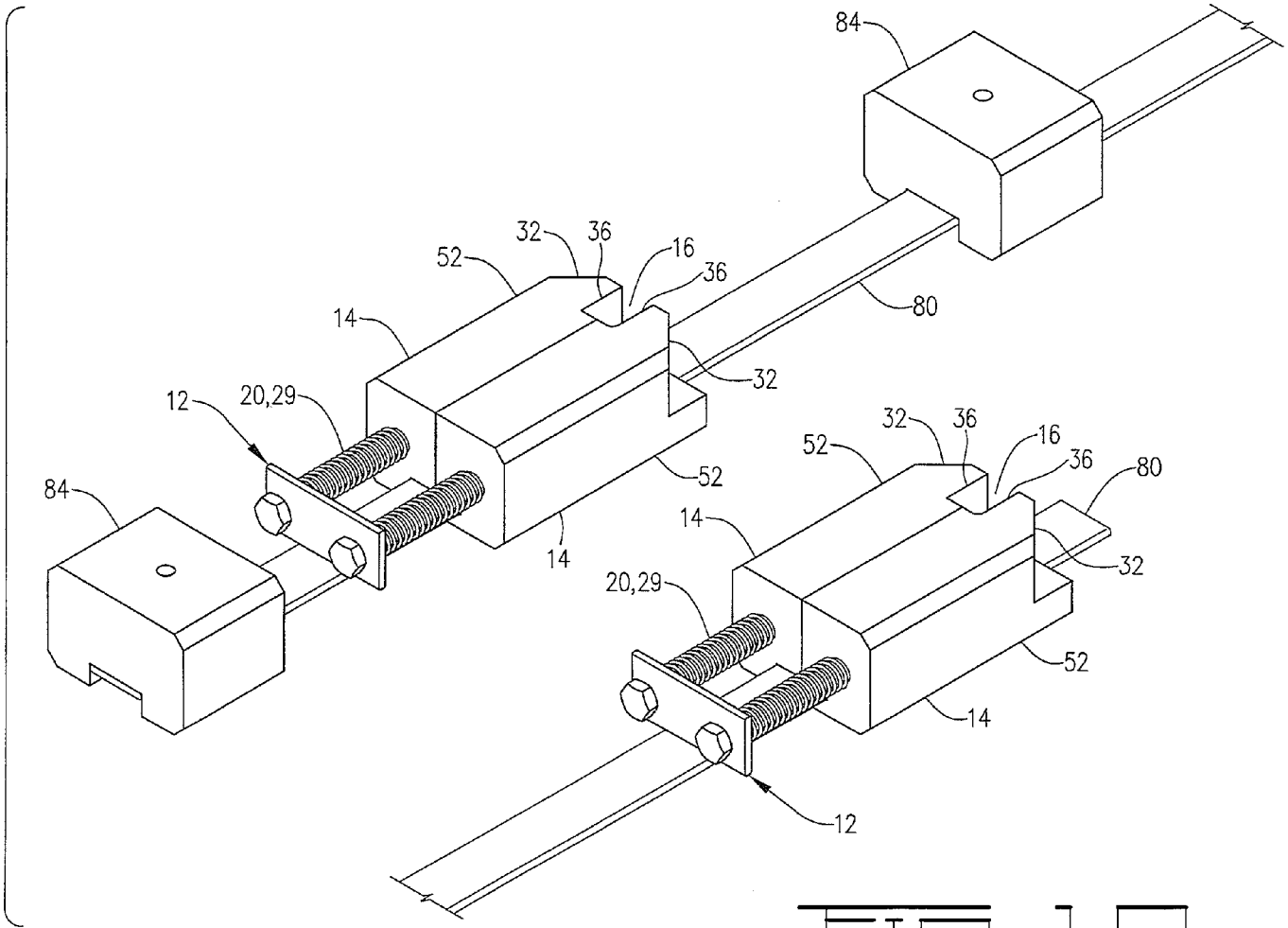
FIG. 10 is an embodiment of the latch assembly including a draw bar and a lift block.
Figure 11A:
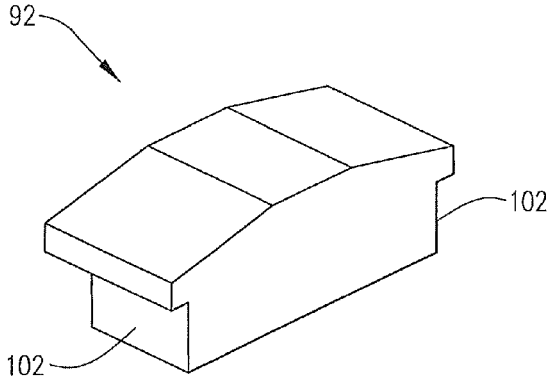
FIG. 11A is a perspective view of an embodiment of a striker support.
Figure 11B:
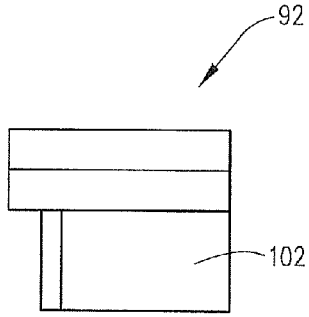
FIG. 11B is a side view of the striker support of FIG. 11A.
Figure 12A:
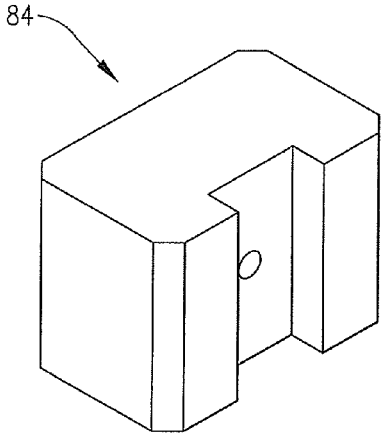
FIG. 12A is a perspective view of an embodiment of a lift block.
Figure 12B:
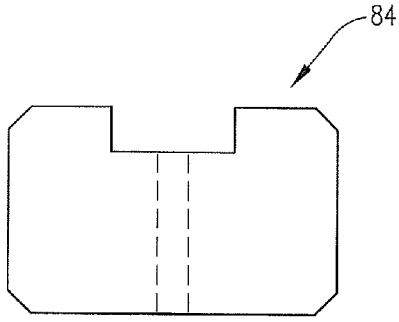
FIG. 12B is a top/bottom view of the lift block of FIG. 12A.

Referring to FIGS. 8A-9B, latch carriage 12 of latch assembly 10 is axially movable from a first position shown in FIGS. 8A and 9B to a second position shown in FIG. 8B. When latch carriage 12 is in the first position and each latch member 14 is in the extended position as shown in FIGS. 8A and 9B, striker retention slot 16 resides in latch opening 60 of housing 56. When latch carriage 12 is in the second position and each latch member 14 is in the extended position as shown in FIG. 8B, a portion of striker retention slot 16 is withdrawn from latch opening 60. Further, the axial movement of each latch member 14 from the extended position to a retracted position shown in FIG. 9A is substantially parallel to the axial movement of latch carriage 12 from the first position to the second position.

Referring to FIGS. 8A-9B, when latch carriage 12 is in the first position and each latch member 14 is in the extended position in latch opening 60, beveled surfaces 32 of latch members 14 may receive a lateral impact from striker member 76. The angle of beveled surface 32 transfers the force of impact in the axial direction defined by rod 20 carrying latch member 14. Upon receiving a lateral impact sufficient to overcome the biasing force provided by spring 29, latch member 14 axially retracts permitting passage of striker member 76 as shown in FIG. 9A. Thereafter, the retracted latch member 14 returns to the extended position, thereby defining striker retention slot 16 about striker member 76 and laterally retaining striker member 76 therein as shown in FIG. 9B. Subsequently, moving latch carriage 12 to the second position withdraws striker retention slot 16 from striker member 76 by a distance sufficient to preclude retention of striker member 76. Moving latch carriage 12 a distance that provides clearance between second end 44 of each latch member 14 and striker member 76 is sufficient to preclude retention of striker member 76.

Referring to FIGS. 6-12B, embodiments of latch assembly 10 including housing 56 can include a draw bar 80, a draw block 84, a handle-operated cam 88, and a striker support 92.

Draw bar 80 is an elongate structure slidable in housing 56 and secured to latch carriage 12 therein. Draw bar 80 extends along the length of housing 56 and moves with latch carriage 12 from the first position to the second position thereof. As shown, draw bar 80 is an elongate metal bar or strap welded to latch carriage 12. However, other known materials such as, for example, a rod, cable, or rope are suitable for draw bar 80.

Secured to draw bar 80 in housing 56 and near elongate opening 64 is draw block 84. Draw block 84 moves with draw bar 80 and latch carriage 12 from the first position to the second position in housing 56. Elongate opening 64 provides access to draw block 84 from the exterior of housing 56. As shown, draw block 84 is a block of polymeric material having generally a rectangular cross-section and sized to slidably fit in housing 56. However, draw block 84 is not limited to any particular configuration or material. For example, draw block 84 may be a pin extending from draw bar 80 near elongate opening 64.

Positioned exterior to housing 56 and near elongate opening 64 is handle-operated cam 88. Handle-operated cam 88 is pivotal about a fulcrum 96 located between each end of handle-operated cam 88. Fulcrum 96 pivotally secures handle-operated cam 88 to the exterior of housing 56 with one end of handle-operated cam 88 accessible exterior to housing 56 and the other end of handle-operated cam 88 positioned through elongate opening 64 and in contact with draw block 84. With both latch carriage 12 and draw block 84 secured to draw bar 80, pivotal movement of handle-operated cam about fulcrum 96 will engage draw block 84 and move latch carriage 12 from the first position to the second position. Housing 56 may include multiple handle-operated cams 88 operable on multiple draw blocks 84.

As depicted in FIG. 6, latch assembly 10 has a latch assembly spring 100 with one end secured to housing 56 and another end in contact with draw block 84. Latch assembly spring 100 biases latch carriage 12 to the first position. In this embodiment, handle-operated cam 88 requires enough pivotal force to overcome the spring tension of latch assembly spring 100 to move latch carriage 12 to the second position.

Housing 56 may optionally include a fixed striker support 92 positioned opposite and near second ends 44 of latch members 14 when latch carriage 12 is in the first position. Striker support 92 has a pair of outer edges 102 substantially aligned with outer edges 52 of latch members 14. Typically, striker support 92 has a convex shape extending between outer edges 102 of striker support 92. The previously described striker member 76 may ride upon the convex shape of striker support 92 when striker member 76 enters latch opening 60. In the event of a slight misalignment of striker member 76 and latch members 14, striker support 92 acts as a guide ensuring the contact of striker member 76 against bevel 32 of latch member 14. Additionally, striker support 92 may cooperate with latch members 14 to further ensure retention of striker member 76 within striker retention slot 16. For example, the convex shape of striker member 76 may apply a force directing striker member 76 toward latch members 14 and supporting striker member 76 in striker retention slot 16. As shown, striker support 92 comprises a polymeric material. The polymeric material enhances quiet operation of latch assembly 10. However, other known materials capable of forming striker support 92, such as, without limitation, steel are suitable.

In operation, a user secures housing 56 in a fixed position, for example, to a gate post such that latch members 14 will receive the previously described lateral impact from striker member 76. As discussed above, when latch carriage 12 is in the first position and each latch member 14 is in the extended position, beveled surfaces 32 of latch members 14 may receive a lateral impact from striker member 76. Beveled surface 32 acts as a force transfer surface permitting closure of the gate carrying striker member 76 without manually actuating latch assembly 10. Upon closing the gate carrying striker member 76, striker member 76 will contact beveled surface 32. The angle of beveled surface 32 transfers the force of impact in the axial direction defined by rod 20. Thus, contact of striker member 76 upon beveled surface 32 overcomes the outward bias provided by spring 29, thereby retracting latch member 14. Once striker member 76 has moved beyond second end 44 of latch member 14, the biasing force of spring 29 returns latch member 14 to the extended position thereby capturing striker member 76 in striker retention slot 16. To release the gate from retention slot 16, the user pulls handle-operated cam 88 against the bias of latch assembly spring 100 thereby engaging draw block 84 carried by draw bar 80 and moving latch carriage 12 from the first position to the second position. Thus, the configuration of latch assembly 10 permits opening or closing of the gate from either direction relative to latch assembly 10.

Other embodiments of the current disclosure will be apparent to those skilled in the art from a consideration of this specification, or practice of the teachings disclosed herein. Thus, the foregoing specification is considered merely exemplary with the true scope and spirit of the disclosure being defined by the attached claims.

What is claimed is:

1. A latch assembly comprising:

a housing;

a latch carriage axially movable relative to the housing;

a pair of rods, each rod movable through said latch carriage, an outwardly biased coil spring positioned around each rod such that each rod passes through the entirety of each coil spring;

a pair of latch members, one latch member of said pair of latch members secured to one of said rods and the other latch member secured to the other rod such that each spring is positioned between the latch carriage and one of said latch members, such that each spring biases one of said latch members to an extended position;

a striker retention slot defined by the latch members when the latch members are in the extended position, wherein the cooperation of the latch members in the extended position provides for retention of a striker member in the striker retention slot.

2. The latch assembly of claim 1, wherein the latch carriage is axially movable relative to the housing from a first position in which the latch members provide retention of the striker member in the striker retention slot to a second position in which the latch members are separated from the striker member by a distance sufficient to preclude retention.

3. The latch assembly of claim 1, wherein each latch member has a beveled surface configured to impart axial force on the latch member upon receiving a lateral impact on the beveled surface.

4. The latch assembly of claim 1, wherein each latch member retracts independently of the other latch member upon receiving a lateral impact from the striker member and returns to the extended position after the striker member passes beyond the retracted latch member.

5. A latch assembly comprising:

a housing supporting the latch assembly;

a latch carriage axially moveable relative to the housing from a first position to a second position;

a pair of rods, each rod movable through said latch carriage, an outwardly biased coil spring positioned around each rod such that each rod passes through the entirety of each coil spring;

a pair of latch members one latch member of said pair of latch members secured to one of said rods and the other latch member secured to the other rod such that each rod may move independently through said carriage, wherein the latch members are independently and axially retractable;

each spring is positioned between the latch carriage and one of said latch members, such that each spring biases one of said latch members to an extended position;

a striker retention slot defined by the latch members, wherein the cooperation of the latch members provides for lateral retention of a striker member in the striker retention slot when the latch carriage is in the first position, and wherein when the latch carriage is in the second position the striker member is located a distance from the striker retention slot, thereby permitting release of the striker member from the striker retention slot.

6. The latch assembly of claim 5, wherein when the latch carriage is in the first position, the latch members retain the striker member in the striker retention slot, and wherein when the latch carriage is in the second position, the latch members are separated from the striker member by a distance sufficient to preclude retention of the striker member in the striker retention slot.

7. The latch assembly of claim 5, wherein each latch member has a beveled surface configured to impart axial force on the latch member upon receiving a lateral impact on the beveled surface.

8. The latch assembly of claim 5, wherein each latch member retracts independently of the other latch member upon receiving a lateral impact from the striker member and returns to the extended position after the striker member passes beyond the retracted latch member.

9. A latch assembly comprising:

a housing supporting the latch assembly, a latch carriage axially moveable relative to the housing from a first position to a second position;

a pair of rods, each rod movable through said latch carriage, an outwardly biased coil spring positioned around each rod such that each rod passes through the entirety of each coil spring;

a pair of latch members, one latch member of said pair of latch members secured to one of said rods and the other latch member secured to the other rod such that each rod movably carried by the latch carriage such that each rod may move independently through said carriage;

each spring is positioned between the latch carriage and one of said latch members, such that each spring biases one of said latch members to an extended position and configured to retract upon receiving a lateral impact;

a striker retention slot defined by the latch members when the latch members are in the extended position, wherein the cooperation of the latch members provides for lateral retention of a striker member in the striker retention slot when the latch carriage is in the first position, and wherein when the latch carriage is in the second position the striker member is located a distance from the striker retention slot, thereby permitting release of the striker member from the striker retention slot.

10. The latch assembly of claim 9, wherein when the latch carriage is in the first position, the latch members retain the striker member in the striker retention slot, and wherein when the latch carriage is in the second position, the latch members are separated from the striker member by a distance sufficient to preclude retention of the striker member in the striker retention slot.

11. The latch assembly of claim 9, wherein each latch member has a beveled surface configured to impart axial force on the latch member upon receiving the lateral impact on the beveled surface.

12. The latch assembly of claim 9, wherein each latch member retracts independently of the other latch member upon receiving a lateral impact from the striker member and returns to the extended position after the striker member passes beyond the retracted latch member.

* * * * *